US006398676B1

(12) United States Patent
Mizek

(10) Patent No.: US 6,398,676 B1
(45) Date of Patent: Jun. 4, 2002

(54) ARROWHEAD WITH INTERCHANGEABLE BLADES

(75) Inventor: Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 09/687,443

(22) Filed: Oct. 13, 2000

Related U.S. Application Data

(60) Division of application No. 09/366,452, filed on Aug. 3, 1999, now Pat. No. 6,174,252, which is a division of application No. 08/907,231, filed on Aug. 6, 1997, now Pat. No. 5,941,784, which is a continuation-in-part of application No. 08/672,624, filed on Jun. 28, 1996, now abandoned, which is a continuation-in-part of application No. 08/368,805, filed on Jan. 5, 1995, now Pat. No. 5,564,713.

(51) Int. Cl.[7] ..... F42B 6/08
(52) U.S. Cl. ..... 473/583
(58) Field of Search ..... 473/578, 582, 473/583, 584, FOR 216, FOR 219, FOR 221, FOR 222

(56) References Cited

U.S. PATENT DOCUMENTS 727,724 A * 5/1903 Weil
2,859,970 A * 11/1958 Doonan
3,036,396 A * 5/1962 Swails
4,166,619 A * 9/1979 Bergmann et al.
4,579,348 A * 4/1986 Jones
5,066,021 A * 11/1991 DeLucia
5,082,292 A * 1/1992 Puckett et al.
5,083,798 A * 1/1992 Massey
5,100,143 A * 3/1992 Puckett
6,287,224 B1 9/2001 Liechty, II ..... 473/584

* cited by examiner

*Primary Examiner*—John A. Ricci
(74) *Attorney, Agent, or Firm*—Pauley Petersen Kinne & Erickson

(57) ABSTRACT

An arrowhead having at least one blade, preferably between two to six blades, which are interchangeably mounted in a pivotal or a fixed position with respect to a blade carrying body. A pin is used to retain a corresponding blade in a pivotal or a fixed position with respect to a blade carrying body. When the blade is pivotally mounted a bias force of a retaining member is preferably selected so that each blade remains in a normally closed position during flight or during handling of the arrowhead, but yet responsively and quickly moves to a fully open position upon impact or when a sufficient opening force is applied to the blade.

17 Claims, 13 Drawing Sheets

ARROWHEAD WITH INTERCHANGEABLE BLADES

This application is a divisional patent application of and claims the benefit of priority under 35 U.S.C. 120 of patent application Ser. No. 09/366,452, filed Aug. 3, 1999, now Pat. No. 6,174,252, which is a divisionial patent application of patent application Ser. No. 08/907,231, filed Aug. 6, 1997, now U.S. Pat. No. 5,941,784, which issued Aug. 24, 1999, which is a continuation-in-part patent application of Ser. No. 08/672,624, filed Jun. 28, 1996, now abandoned, which is a continuation-in-part patent application of Ser. No. 08/368,805, filed Jan. 5, 1995, now U.S. Pat. No. 5,564,713, which issued Oct. 15, 1996.

BACKGROUND OF THE INVENTION

1. Field of the Invention

This invention relates to an arrowhead with interchangeable blades that can operate as either a fixed-blade arrowhead or a blade-opening arrowhead having at least one blade which is pivotally mounted to move between a fully open position and a fully closed position wherein there is a positive snap locking blade retention system that maintains each blade in a normally closed position.

2. Description of Prior Art

In the archery industry, many manufacturers have attempted to simultaneously achieve an arrowhead that has aerodynamic properties similar to those associated with non-bladed arrowheads known as field points or nib points, while also achieving effective cutting areas provided by bladed arrowheads, which are often referred to as broadheads. Broadhead blades which are exposed during flight often result in undesirable steering of the front portion of the arrow, causing the arrow to deviate from a perfect flight path that coincides with a longitudinal axis of the arrow shaft, when loaded or drawn within an archery bow.

By reducing the surface area of a broadhead blade, the undesirable steering effects can be reduced. However, when the surface area of a blade is significantly reduced, the structural integrity is diminished. Also, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed surface area is reduced and thus produces relatively less undesirable steering effects.

Many of such conventional blade-opening arrowheads rely upon complex mechanisms, some of which fail to open because of a significant holding or closing force that must be overcome, and others that open prematurely because of structural deficiencies within the blade carrying body that fail upon impact, resulting in non-penetration of the arrow. With such relatively complex mechanisms, dirt or other materials that may enter such conventional arrowheads can affect the reliability of the arrowhead, particularly after prolonged use.

Other conventional broadheads which have blades partially hidden within the body use annular retaining rings, such as O-rings, wraps, bands and the like, in order to maintain the blades in a closed position during flight. Upon impact, such annular retaining rings are designed to sheer or roll back alone the opening blades, in order to allow the blades to move to an open position. Quite often, such conventional annular retaining rings are prone to cracking, particularly when the elastomer material dries out. Upon release of a bow string, the rapid acceleration and thus significant opening forces move the blades in an opening direction. The conventional annular retaining rings counteract such opening forces. However, when the ring material dries out, cracks or is otherwise damaged, the blades may open prematurely, resulting in significant danger or injury to the archer.

Many of the annular retaining rings are designed for one use and thus must be replaced after each use. In addition to the cost involved with supplying such consumable item, the annular retaining ring is difficult and time-consuming to install, such as when hunting, particularly during inclement weather. Furthermore, the material properties of such conventional annular retaining rings can be affected by temperature changes, thereby resulting in different bias forces that cause the blade to open prematurely or to not open when desired.

U.S. Pat. No. 5,090,709 teaches an arrowhead with extendable blades positioned adjacent fixed blades. The extendable blades are pivotally connected to a body. A ring releasably holds the extendable blades within corresponding slots within the body.

U.S. Pat. No. 5,286,035 teaches an arrowhead that has a sharpened blade, pivotally mounted within a slot in the body of the arrowhead. A rubber O-ring is used to hold the blade in a temporarily stationary position, centered within the slot in the body. Upon impact, the rubber O-ring slides rearward onto the arrow shaft and allows the blade to pivot to either side of the arrowhead body.

U.S. Pat. Nos. 5,112,063, 4,998,738 and 5,082,292 each disclose a broadhead with deployable cutting blades that are connected by pivot pins to a plunger. The cutting blades pivot between an open cutting position and a closed non-barbed position.

U.S. Pat. No. 5,102,147 discloses a ballistic broadhead assembly that has blades pivotally mounted on an actuating plunger. Upon impact, the actuating plunger thrusts the blades outwardly and forwardly.

It is apparent from the conventional blade-opening arrowheads that there is a need for a blade-opening arrowhead that maintains each blade in a closed and locked position during flight, and that allows the blades to responsively free-wheel to an open position when a sufficient opening force is applied to the blade. It is apparent that there is a need for a blade-opening arrowhead that does not require consumable items, such as 0-rings, wraps, bands and the like, to hold the blades in a closed position. It is also apparent that there is a need for an arrowhead that will accommodate fixed blades in addition to and/or in lieu of pivotally mounted blades for example to accommodate dull practice blades or other sharpened fixed blades.

SUMMARY OF THE INVENTION

It is one object of this invention to provide an arrowhead with interchangeable blades wherein a dull blade or a sharpened blade can be interchanged with a pivotally mounted blade.

It is another object of this invention to provide an arrowhead with pivotally mounted blades that can be maintained in a normally closed position, wherein a major portion of each blade is housed within a slot of the blade carrying body, and that pivot rearwardly into a fully open position upon target impact or upon experiencing a similar opening force.

It is another object of this invention to provide an arrowhead with pivotally mounted blades that each have a rounded, blunt tip portion that is the portion of the blade that initially contacts a target.

It is another object of this invention to provide a blade-opening arrowhead wherein various types of springs and engaging elements can be used to maintain pivotally mounted blades in a normally closed position but which also provides a bias force that can be overcome by an opening force applied to the blade when in the closed position.

It is still another object of this invention to eliminate the need for consumable mechanical components, such as 0-rings, bands, wraps and the like, which are conventionally used to maintain opening blades in a closed position during flight and also during handling of the arrowhead.

It is yet another object of this invention to provide an improved design for a blade which is used in a blade-opening arrowhead.

The above and other objects of this invention are accomplished with an arrowhead that has a blade carrying body, which is also known to those skilled in the art as a ferrule. In one preferred embodiment according to this invention, at least one dull or sharpened fixed blade, preferably 2–4 dull or sharpened fixed blades, is each mounted in a fixed position with respect to the blade carrying body. In another preferred embodiment according to this invention, at least one blade, preferably 2–4 blades, are each pivotally mounted with respect to the blade carrying body. In one preferred embodiment according to this invention, a pivot shaft is mounted with respect to the blade carrying body. For example, the pivot shaft can be completely positioned within the blade carrying body so that no portion of the pivot shaft extends beyond the skin or outside surface of the blade carrying body. Each blade, fixed or pivoted, preferably hag a slot or a through hole in which the pivot shaft is matingly engaged, thus allowing the blade to be fixed or to pivot with respect to the blade carrying body.

In one preferred embodiment, each blade pivots between a normally closed position and a fully open position. In the normally closed position of the pivotal blade and in the mounted position of the fixed blade, each blade is preferably positioned such that a major or a significant portion of the blade is housed within a slot formed by the blade carrying body. In the fully closed position of the pivotal blade, a sharp edge of the blade is preferablly non-exposed for safety reasons. A major or significant portion of each blade, fixed or pivotal, is preferably housed within the blade carrying body, so that during flight the arrowhead according to this invention achieves very favorable aerodynamic qualities and characteristics.

In the fully open position of the pivotal blade, each blade preferably has a blunt edge, opposite the sharp edge, which abuts or contacts a correspondingly mateable base edge formed by the blade carrying body, preferably in an area where the blade carrying body forms the slot that houses the blade. In one preferred embodiment according to this invention, the blunt edge of the blade has an overall generally convex arcuate section and the blade carrying body has a corresponding generally concave arcuate section. Thus, when the pivotal blade is in a fully open position or when the fixed blade is in a mounted position, there is preferably but not necessarily substantial bearing surfaces contact between the blunt edge of the blade and the base edge of the blade carrying body. By providing increased surface area contact between the blade and the blade carrying body, impact forces are better transferred through the blade, through the blade carrying body and into the arrow shaft as compared to line or point contact. The arrowhead structure according to this invention acts more as an integral unit as opposed to a conventional blade-opening arrowhead wherein the impact forces are typically transferred through the pivot shaft or a similar component.

According to one preferred embodiment of this invention, the pivotal blade is held in the normally closed position by contacting an engaging element with a portion of the blade. A bias force, such as from a spring element, is used to urge the engaging element against the pivotal blade.

In one preferred embodiment according to this invention, the engaging element is a generally flattened tab which has a raised portion, which is also referred to as an upset. In another preferred embodiment according to this invention, the engaging element is a raised portion or a detent formed in a leaf spring. In such preferred embodiments, each blade has a recess and in the closed position, the raised portion, detent or upset is mateably engaged within the recess. In one preferred embodiment, the spring element can be the generally flattened tab itself, acting as a leaf spring.

In another preferred embodiment according to this invention, the locations of the raised portion and the recess can be interchanged so that the recess is formed within the generally flattened tab or leaf spring and the raised portion is formed on the blade. It is also apparent that the raised portion and the recess can have any suitably shaped cross section or overall shape.

In another preferred embodiment according to this invention, the engaging element is a plunger shaft that is slidably mounted within the blade carring body. In such preferred embodiment, the spring element is a coil spring mounted in such a manner that it normally urges the plunger shaft toward a corresponding pivotal blade. The corresponding pivotal blade has a notch which is shaped to mate with or accommodate the shape of the plunger shaft. When the blade is in the normally closed position, the plunger shaft is mated within the notch to prevent opening movement of the pivotal blade.

In the preferred embodiments of this invention as discussed above, the spring element is preferable designed so that a sufficient bias force is applied to the pivotal blade in order to prevent the pivotal blade from pivoting out of the normally closed position, even when relatively small forces are applied to the pivotal blade in an opening direction, such as when handling the arrowhead or during flight of the arrowhead. The spring element is also designed so that the bias force is easily overcome when a more significant force is applied in the opening direction, such as when the arrowhead impacts a target.

Other preferred embodiments of the engaging element and the spring element will be discussed in the following description of this invention. The blade-opening arrowhead according to this invention requires no consumable element, such as an O-ring, a band, a wrap or other similar element, in order to maintain the pivotal blades in a normally closed position. Eliminating such consumable element associated with conventional blade-opening arrowheads improves the safety aspects of the arrowhead, significantly reduces the cost for using the arrowhead by eliminating the need for a user to purchase consumable goods, and also eliminates awkward handling of the arrowhead when attempting to install such conventional consumable element particularly during a time-critical hunt.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
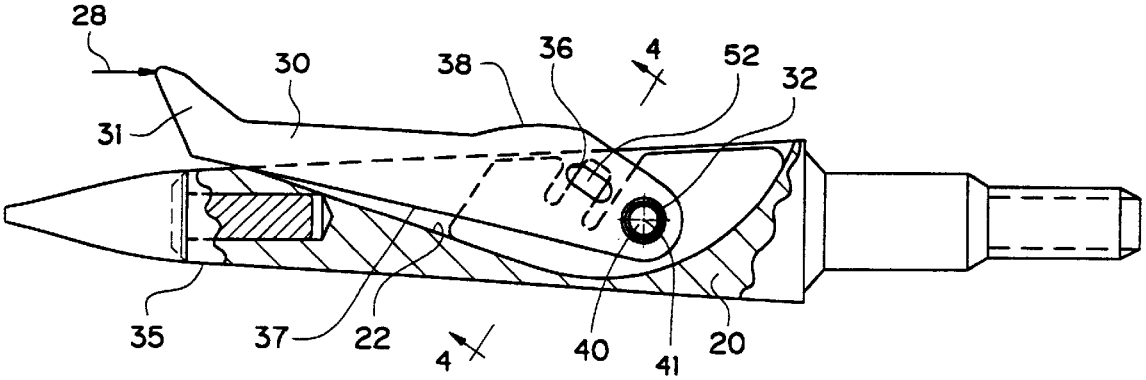
FIG. 1 is a partial cross-sectional front view of a blade-opening arrowhead, exposing a pivotally mounted blade at least partially housed within a closed slot of a blade carrying body, with the blade in a closed position, according to one preferred embodiment of this invention.

FIGS. 1–4, 21 and 22 show a blade-opening arrowhead, according to two different preferred embodiments of this invention. As shown in FIGS. 1, 2, 21 and 22 pivot means are used to pivotally mount at least one blade 30, preferably 2–4 blades 30, with respect to blade carrying body 20. As clearly shown in FIGS. 1, 12, 21 and 27 pivot shaft 40 is mounted with respect to blade carrying body 20. Each blade 30 preferably has a through hole or a blind bore within which pivot shaft 40 is mateably mounted. By forming a relatively tight clearance between blade 30 and pivot shaft 40, blade 30 can easily rotate about pivot shaft 40, without significant blade wobble. It is apparent that the contacting surfaces between pivot shaft 40 and blade 30 can be machined or polished to provide a relatively tight tolerance with relatively minimal friction. Once blade 30 is unlocked or released from the normally closed position shown in FIGS. 1 and 21 and pivots towards the fully open position shown in FIGS. 2 and 22, it is important for blade 30 to easily pivot or free-wheel. Such easy pivoting or free-wheeling motion assures easy opening of blades 30 when the arrowhead impacts a target or when a sufficient opening force 28 is applied to blade 30.

Figure 2:
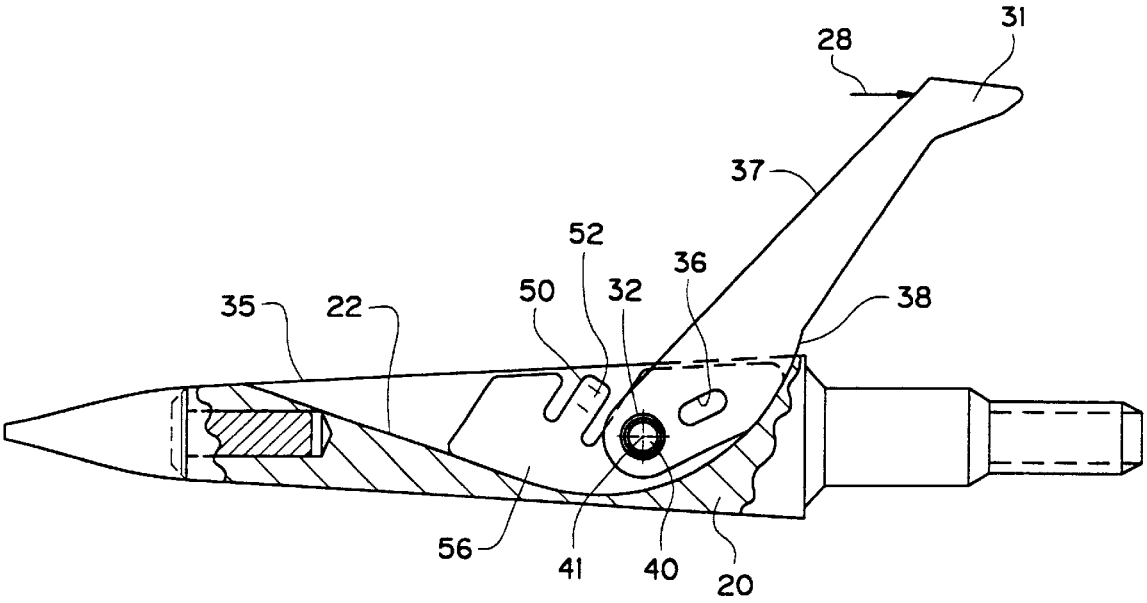
FIG. 2 is similar to FIG. 1, but with the pivotal blade in an open position.
Figure 21:
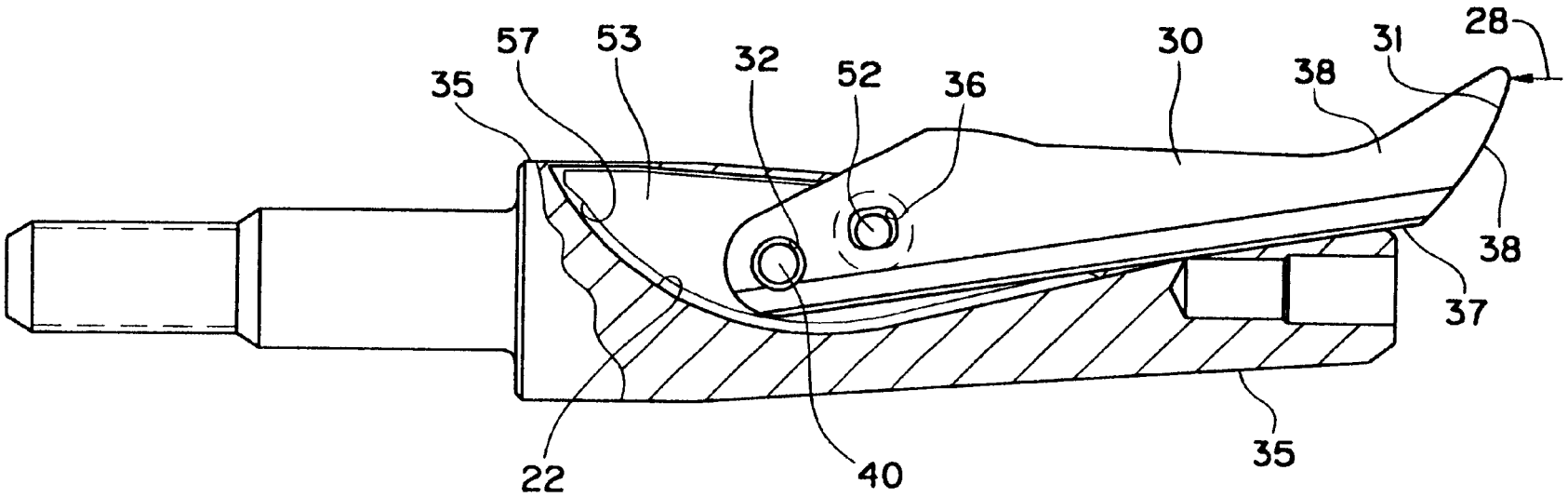
FIG. 21 is a partial cross-sectional front view of a blade-opening arrowhead, exposing a pivotally mounted blade at least partially housed within a closed slot of a blade carrying body, with the pivotal blade in a closed position, according to another preferred embodiment of this invention.
Figure 22:
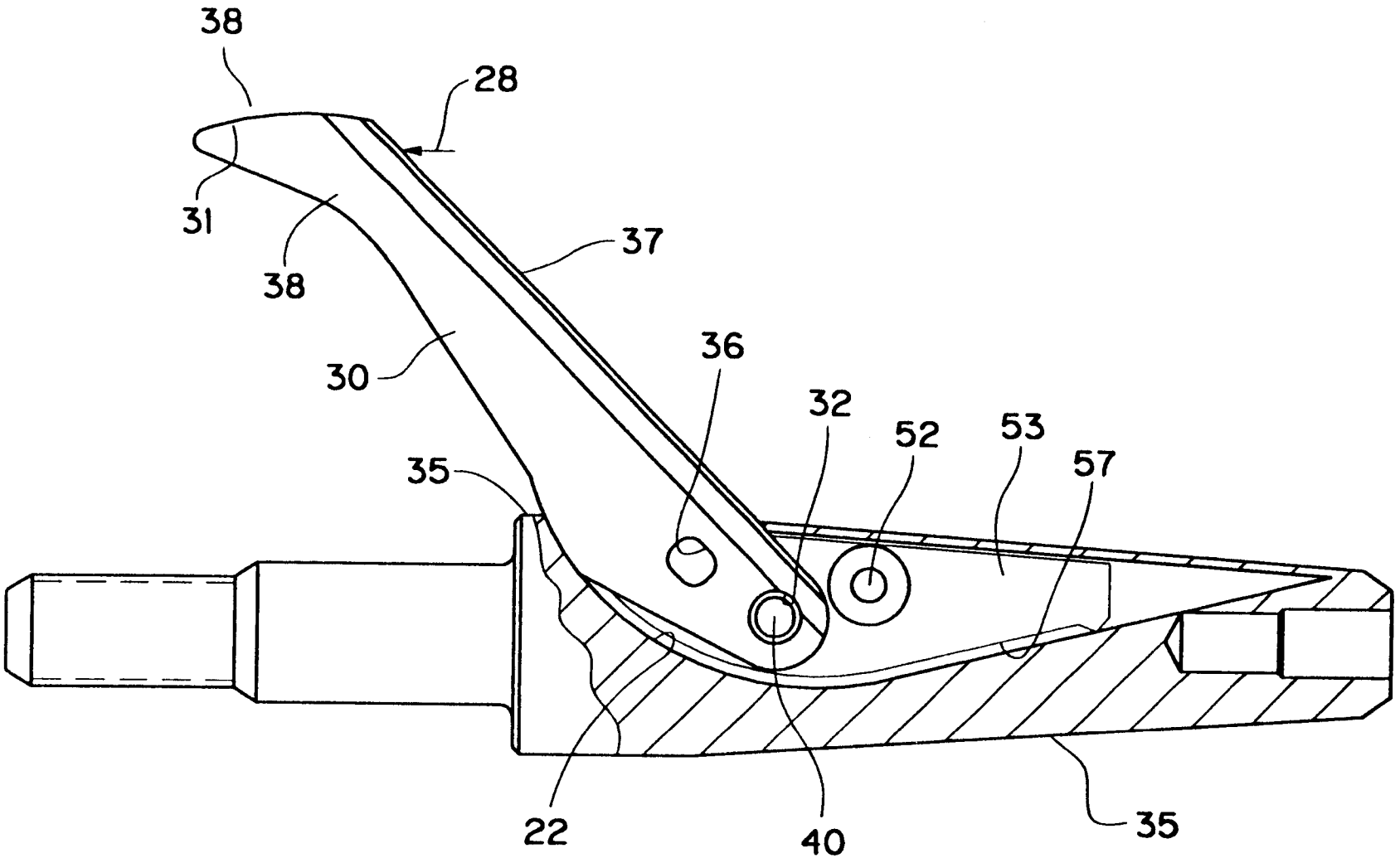
FIG. 22 is similar to FIG. 21, but with the pivotal blade in an open position.
Figure 23:
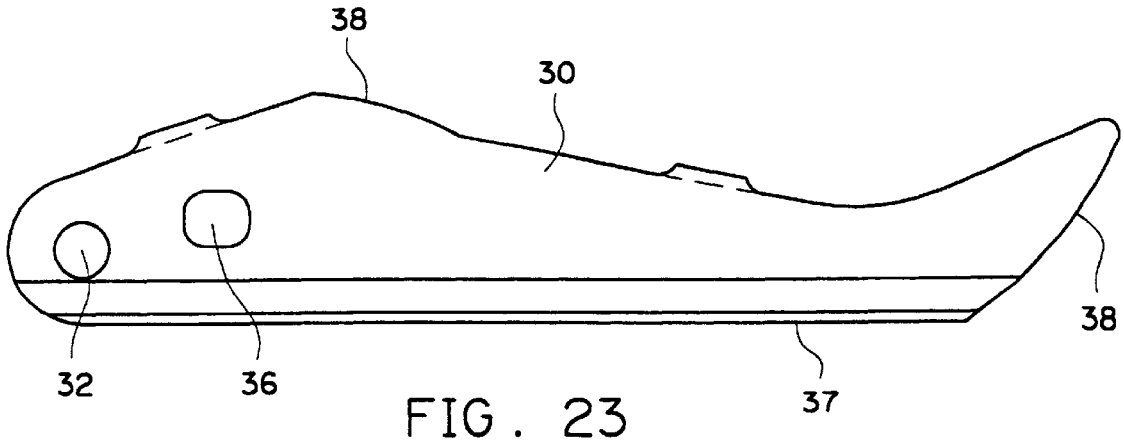
FIG. 23 is a front view of a pivotal blade, according to one preferred embodiment of this invention.

Opening force 28 causes blade 30 to pivot in a clockwise direction, for example, as shown in FIGS. 1 and 2, about pivot shaft 40. As the arrowhead impacts a target, the target surface preferably impinges upon tip portion 31 of blade 30 and thereby provides the necessary opening force 28 for moving each blade 30 from the closed position to the open position. FIGS. 21–23 show one preferred embodiment of a blade that is particularly suitable for ensuring that blade 30 pivots to the open position upon blade-to-target impact. In the closed position of blade 30, the forwardmost portion of the blade is preferably but not necessarily rounded and blunt thereby providing a bearing surface rather than a cutting or puncturing surface upon blade-to-target impact. Opening force 28 can be applied to blade 30 in any direction that does not intersect with center axis 41 of pivot shaft 40. Extending tip portion 31 in the direction as shown in FIG. 1 increases the length of a moment arm between center axis 41 and opening force 28, which results in a lesser force required to overcome the bias force applied to blade 30, as discussed below in more detail.

FIGS. 1–4, 21 and 22 show, for reasons of clarity, the blade-opening arrowhead having only one pivotally mounted blade 30. The blade-opening arrowhead according to this invention will preferably have 2–4 blades 30 each pivotally mounted with respect to blade carrying body 20. FIG. 4A shows a cross section of blade carrying body 20 having two closed slots 25 and 27 within each of which is housed one pivotally mounted blade 30. FIG. 4A also shows how two stationary blades 70 can be mounted with respect to blade carrying body 20, between both pivotally mounted blades 30. It is apparent that one or more stationary blades 70 can be used with at least one pivotally mounted blade 30.

Figure 27:
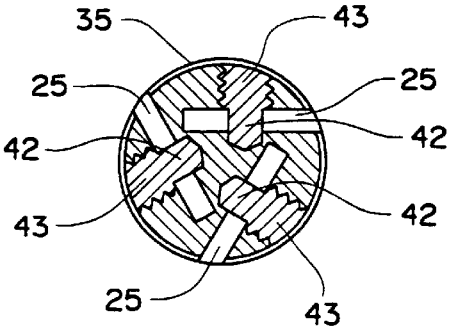
FIG. 27 is a sectional view taken along line 27—27, as shown in the blade carrying body of FIG. 26.

The desired weight and overall size of the blade-opening arrowhead according to this invention will dictate the number of pivotally mounted blades 30 and stationary blades 70, if any. When a plurality of blades 30 are used, such blades 30 should preferably be positioned so that they evenly balance the arrowhead. For example, as shown in FIG. 27, blades 30 are spaced at generally equal circumferential locations. For aerodynamic reasons, it is important to have an arrowhead that is balanced along a centerline axis of blade carrying body 20.

Pivot shaft 40 preferably has a generally circular cross section. However, it is apparent that pivot shaft 40 can have any other suitable cross section which can be used to pivotally mount blade 30 with respect to blade carrying body 20. Because of the increased bearing surface area between blade 30 and pivot shaft 40, which tends to prevent blade wobble, a generally circular cross section is preferred. In one preferred embodiment of pivot shaft 40, as shown in FIG. 27, inner segment 42 has a smaller diameter than outer segment 43. Also as shown in FIG. 27, inner segment 42 has a smooth bearing surface and is not threaded. However, it is apparent that inner segment 42 of pivot shaft 40 can also be externally threaded.

Figure 18:
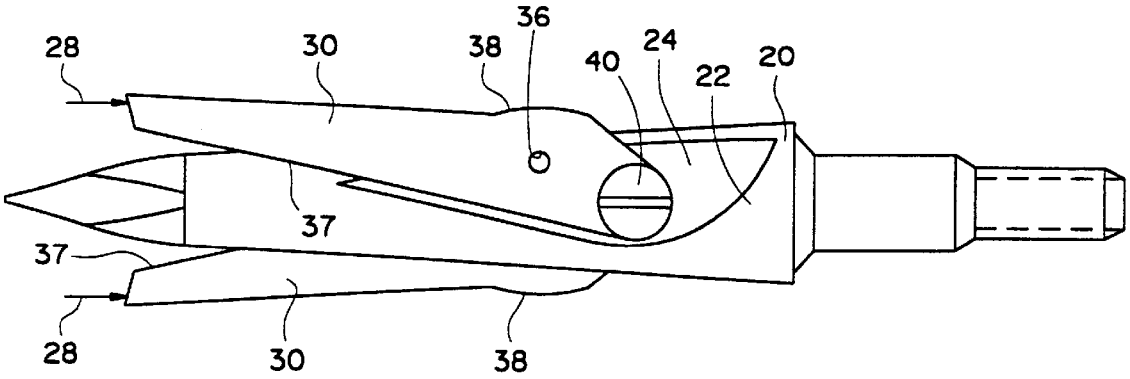
FIG. 18 is a front view of a blade-opening arrowhead in a closed position, wherein the pivotal blades are each mounted externally with respect to the blade carrying body, according to one preferred embodiment of this invention.
Figure 19:
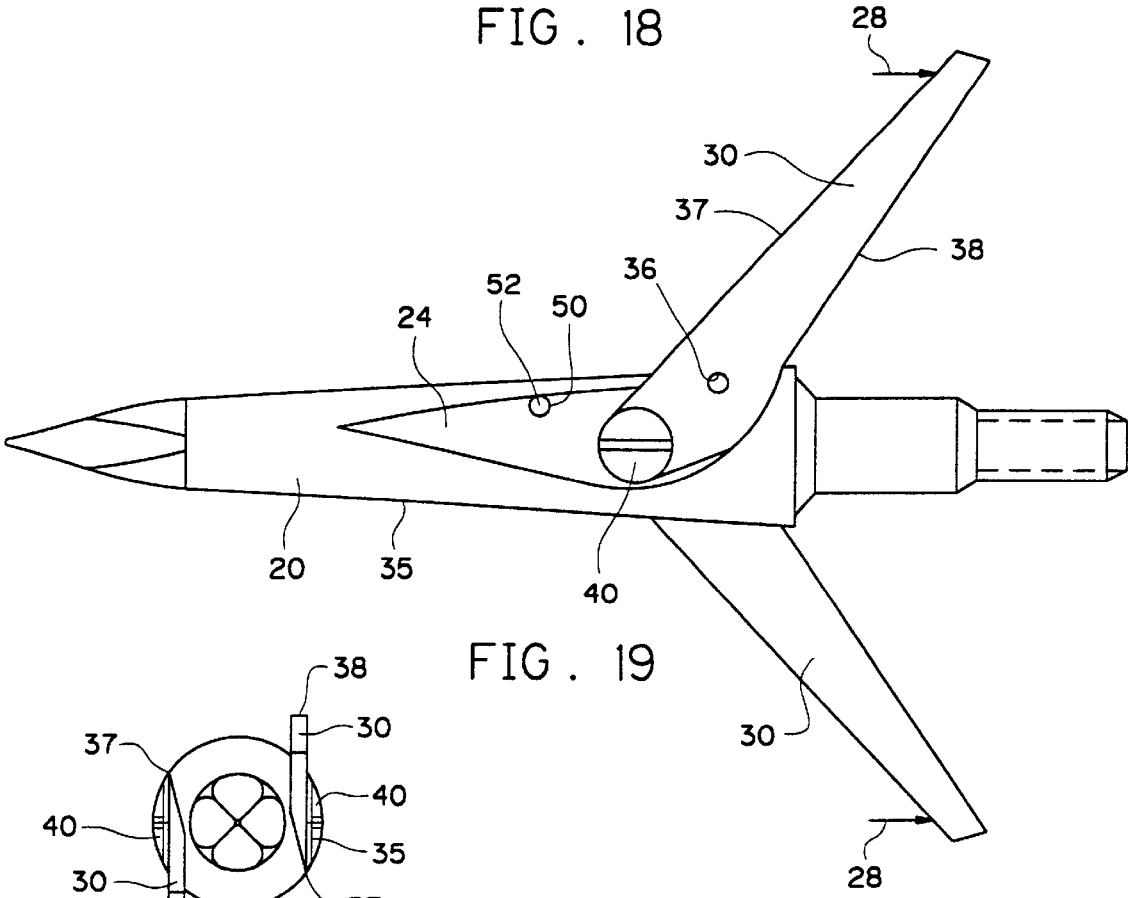
FIG. 19 shows the same blade-opening arrowhead as shown in FIG. 18, but with both pivotal blades in a fully open position.
Figure 20:
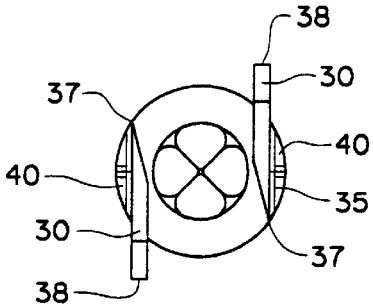
FIG. 20 is a side view of the blade-opening arrowhead shown in FIG. 19, looking in a direction from left to right.

Although pivot shaft 40 is preferably mounted within blade carrying body 20 so that no portion of pivot shaft 40 extends beyond skin surface 35 of blade carrying body 20, it is apparent that at least a portion of pivot shaft 40 could extend beyond skin surface 35 of blade carrying body 20, for example as shown in FIGS. 18–20. Pivot shaft 40 can be mounted within blade carrying body 20 so that pivot shaft 40 is either fixed or movable with respect to blade carrying body 20.

Figure 4:
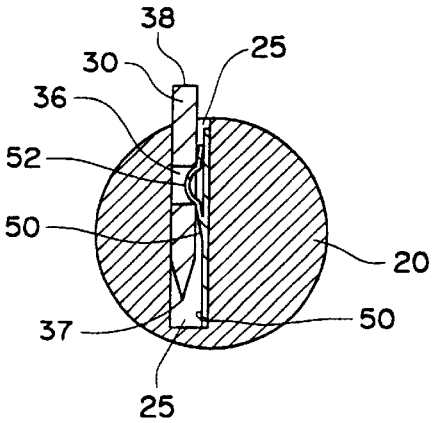
FIG. 4 is a sectional view taken along line 4–4, as shown in FIG. 1.
Figure 4A:
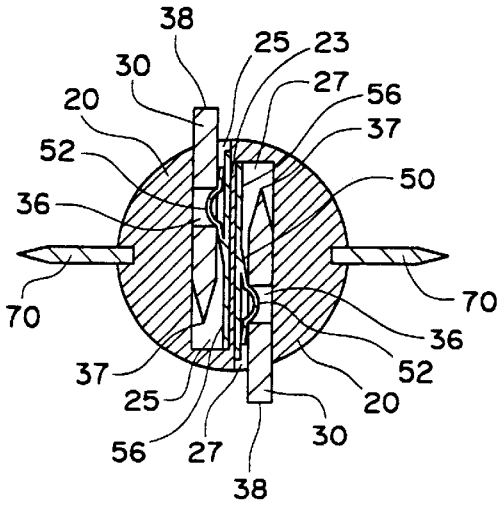
FIG. 4A is a sectional view similar to the sectional view of FIG. 4, but with a blade carrying body having two slots for housing two corresponding blades.
Figure 5:
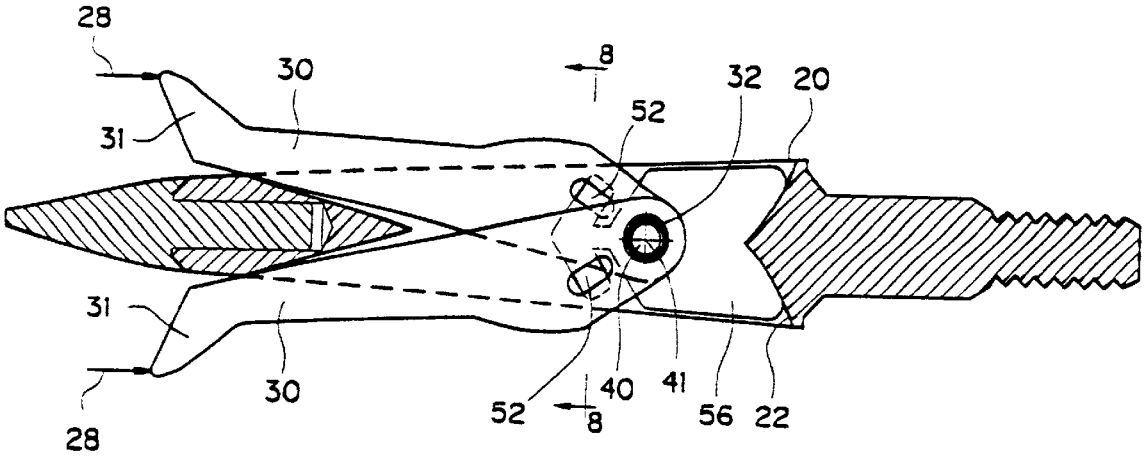
FIG. 5 is a partial cross-sectional front view of a blade-opening arrowhead, exposing two pivotally mounted blades each in a closed position, according to another preferred embodiment of this invention.
Figure 6:
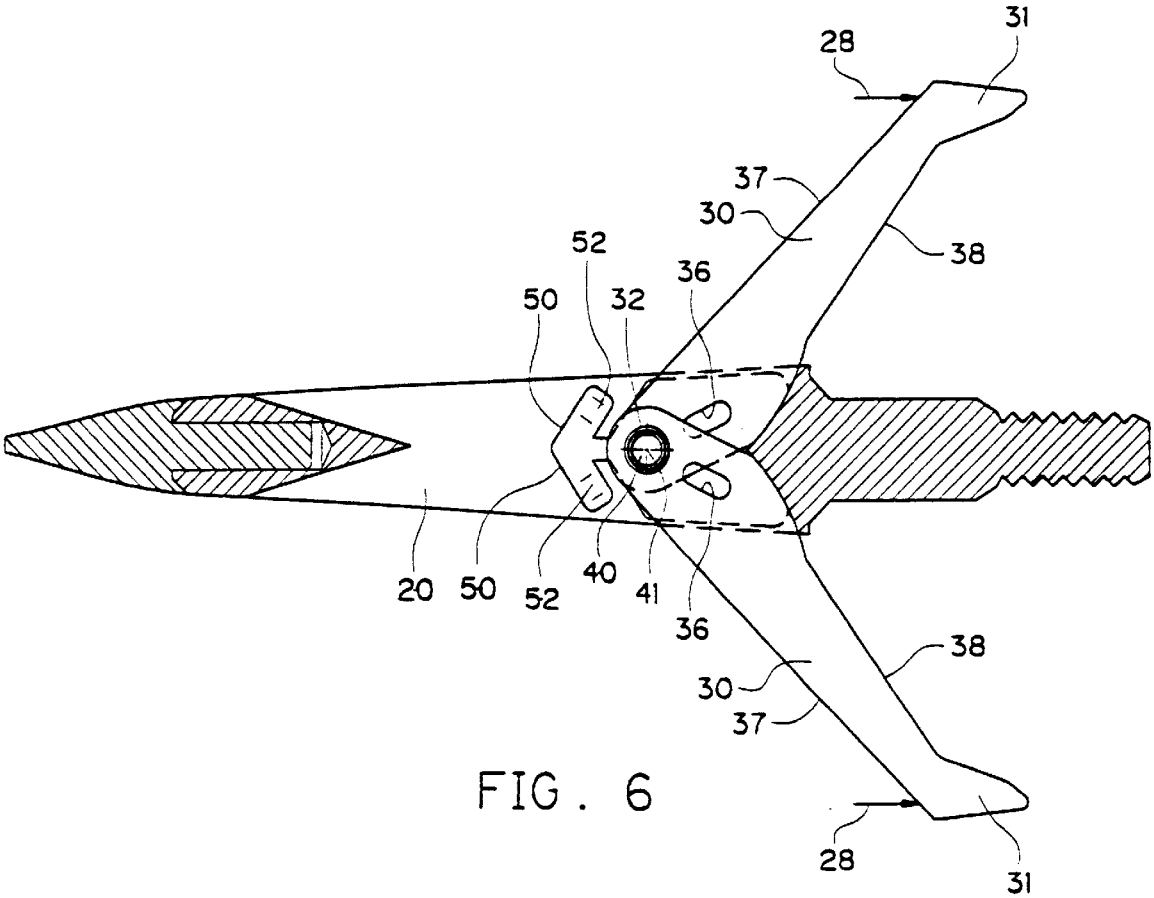
FIG. 6 is a partial cross-sectional front view similar to that shown in FIG. 5, but with the pivotal blades in a fully open position.

FIGS. 5–8 show a blade-opening, arrowhead according to another preferred embodiment of this invention. In the embodiment shown in FIGS. 1–4, blade carrying body 20 forms at least one closed slot 25, preferably two closed slots 25 and 27 as shown in FIG. 4A, which each house one blade 30. In the embodiment shown in FIGS. 5–8, two blades 30 are each mounted within open slot 29, which extends entirely through blade carrying body 20. Because an island or web 23 of material that remains between closed slot 25 and closed slot 17, in blade carrying body 20 housing two blades 30, as shown in FIG. 4A, the structural strength of blade carrying body 20 can be greater than the structural strength of blade carrying body 20 having open slot 29 extending entirely through blade carrying body 20, as shown in FIG. 6.

According to this invention, engagement means are used to maintain blade 30 in a normally closed position, as illustrated in FIGS. 1 and 5, for example. Bias means are used to provide a bias force that is strong enough to urge the engagement means against blade 30 and maintain blade 30 in a normally closed position, yet weak enough so that the magnitude and direction of the bias force are easily overcome when opening force 28 is applied to blade 30. Thus, according to this invention, blade 30 can easily pivot or free-wheel from the fully closed position shown in FIGS. 1 and 5 to the fully open position shown in FIGS. 2 and 6.

Figure 8:
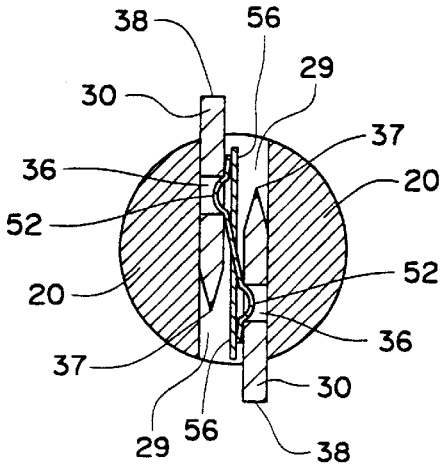
FIG. 8 is a sectional view taken along line 8—8, as shown in FIG. 5.
Figure 14:
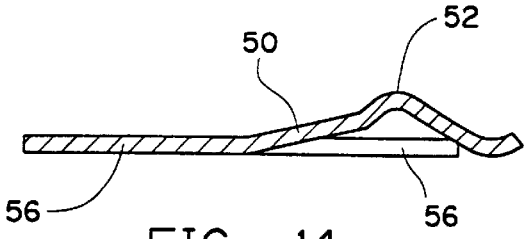
FIG. 14 is a sectional view taken along line 14—14, of the spring element as shown in FIG. 11.

According to one preferred embodiment of this invention, the engagement means comprise flexible member 50 deflectably mounted with respect to blade 30. As used throughout this specification and in the claims, the phrase deflectably mounted is intended to relate to flexible member 50 mounted so that flexible member 50 can deflect in a particular direction. Flexible member 50 preferably acts as a cantilever having one fixed end and an opposite deflectable free end. As shown in FIGS. 4, 8 and 14, flexible member 50 is preferably constructed with plate material or foil material which can be shaped to form raised portion 52. Raised portion 52 may also be known as and referred to as an upset. The engagement means preferably comprise blade 30 having bore or recess 36 within which raised portion 52 mates when blade 30 is in the normally closed position. It is apparent that bore or recess 36 can be a blind bore or a through hole having a shape that corresponds to raised portion 52. It is apparent that raised portion 52 can have an, suitable shape that corresponds and mates with recess 36.

Figure 3:
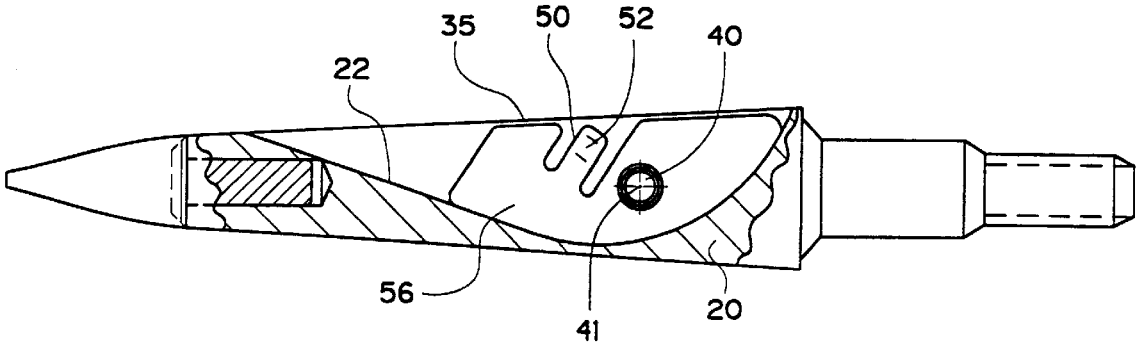
FIG. 3 is a partial cross-sectional front view of the blade-opening arrowhead shown in FIG. 1, with the pivotal blade removed for clearly showing bias means used to maintain the pivotal blade in a normally closed position, according to one preferred embodiment of this invention.
Figure 7:
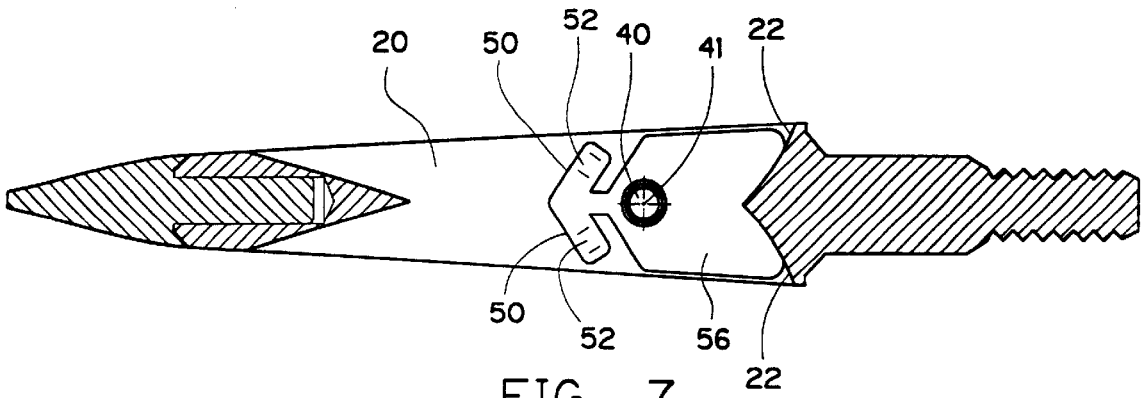
FIG. 7 is a partial cross-sectional front view of the blade-opening arrowhead shown in FIG. 5, with the pivotal blades removed for clearly showing bias means used to maintain the pivotal blade in a normally closed position, according to another preferred embodiment of this invention.
Figure 24:
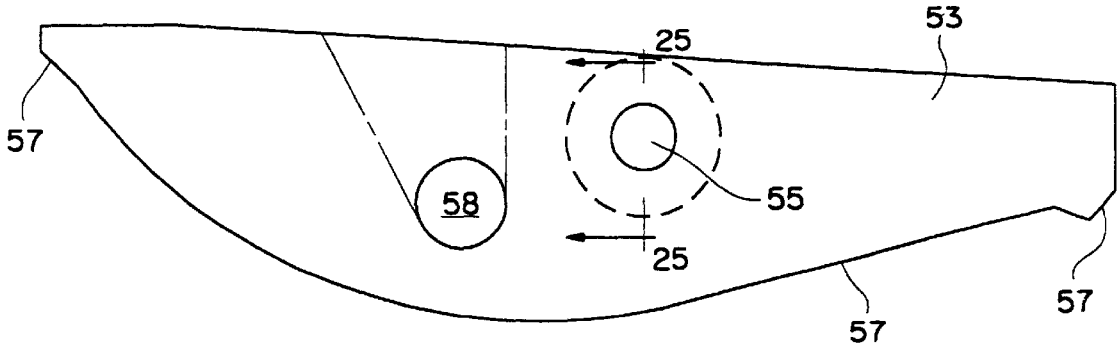
FIG. 24 is a front view of a leaf spring, according to one preferred embodiment of this invention.
Figure 25:
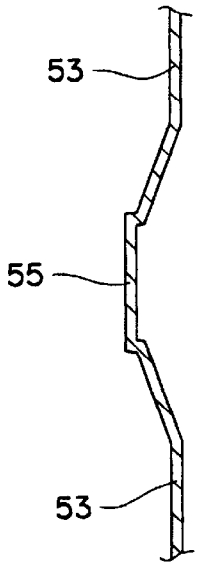
FIG. 25 is a sectional view of a raised portion, taken alone line 25—25, as shown in FIG. 24.

As clearly shown in FIGS. 3, 7 and 14, flexible member 50 is preferably formed as a leaf spring. FIGS. 24 and 25 show another preferred embodiment of the bias means comprising leaf spring 53 having raised portion 52 formed as detent 55, as clearly shown in FIG. 25. The bias force within the leaf spring urges raised portion 52 within recess 36, in the normally closed position of blade 30. It is apparent that flexible member 50 may be formed from any other suitable material, such as a bent wire or any other suitable spring element known to those skilled in the art.

Figure 13:
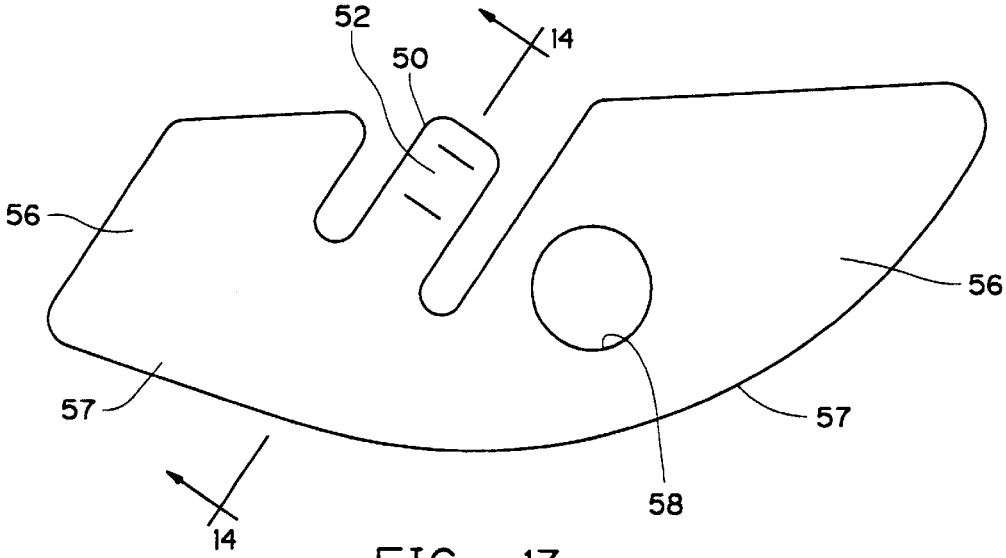
FIG. 13 is a front view of a spring element, according to one preferred embodiment of this invention.

Flexible member 50 is preferably connected to baseplate 56, as shown in FIGS. 3, 7, 13 and 15. Baseplate 56 is shown as being constructed of generally flat plate material. However, it is apparent that baseplate 56 can be constructed of any other material or have any other suitable shape which corresponds to the mating shape of blade carrying body 20, where baseplate 56 is positioned. As shown in FIG. 13, flexible member 50 acts as a cantilever having one end fixed with respect to baseplate 56 and an opposite free end urged toward blade 30. As shown in FIGS. 24 and 25, a cantilevered flexible member 50 is not necessary and can be interchanged with leaf spring 53 having detent 55.

Figure 15:
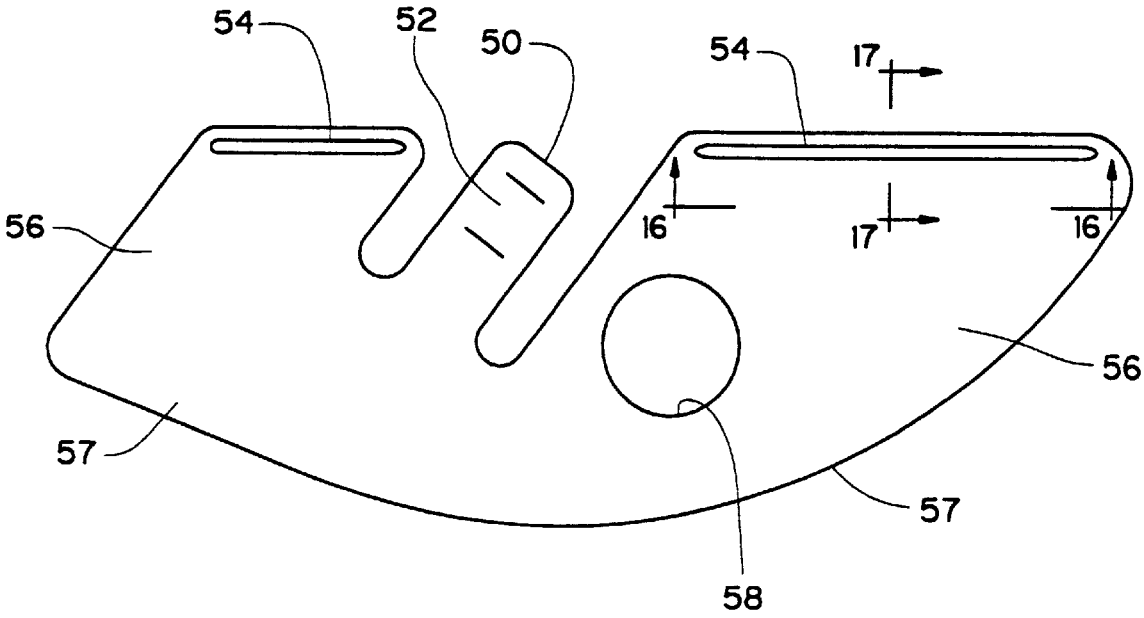
FIG. 15 is a front view of a spring element, according to another preferred embodiment of this invention.

When flexible member 50 is in a mounted position with respect to blade carrying body 20, as shown in FIG. 3, side edge 57 of baseplate 56, shown in FIGS. 13 and 15, abuts sidewall 22 of blade carrying body 20. As shown in FIG. 13, according to one preferred embodiment of this invention, side edge 57 has a convex arcuate shape which corresponds to the concave arcuate shape of sidewall 22. Thus, when pivot shaft 40 is mounted within through hole 58 of baseplate 56, the forward portion of side edge 57 abuts the forward portion of sidewall 2 to prevent counterclockwise movement, relative to the orientation shown in FIG. 1, of baseplate 56 with respect to blade carrying body 20, as blade 30 moves toward and into the normally closed position. Likewise, the rearward portion of side edge 57 abuts the rearward portion of sidewall 22, in order to prevent clockwise rotation of baseplate 56 with respect to blade carrying body 20, as blade 30 moves toward the fully open position, as shown in FIG. 2.

Although not necessary, it is preferred that baseplate 56 remains in a relatively fixed position with respect to blade carrying body 20. As shown in the mounted positions of FIGS. 3 and 7, baseplate 56 will actually move with respect to blade carrying body 20, to the extent of the tolerances between such components. It is apparent that baseplate 56 can be fixedly secured with respect to blade carrying body 20 by using adhesives, welding techniques, or any other suitable securement means known to those skilled in the art. It is even possible to extend and bend base plate 56 so that an edge portion of baseplate 56 extends beyond closed slot 25 or open slot 29 and over skin surface 35 of blade carrying body 20. Maintaining the relative position of baseplate 56 results in maintaining the relative position of flexible member 50 so that raised portion 52 can properly align with and mate within recess 36.

Figure 9:
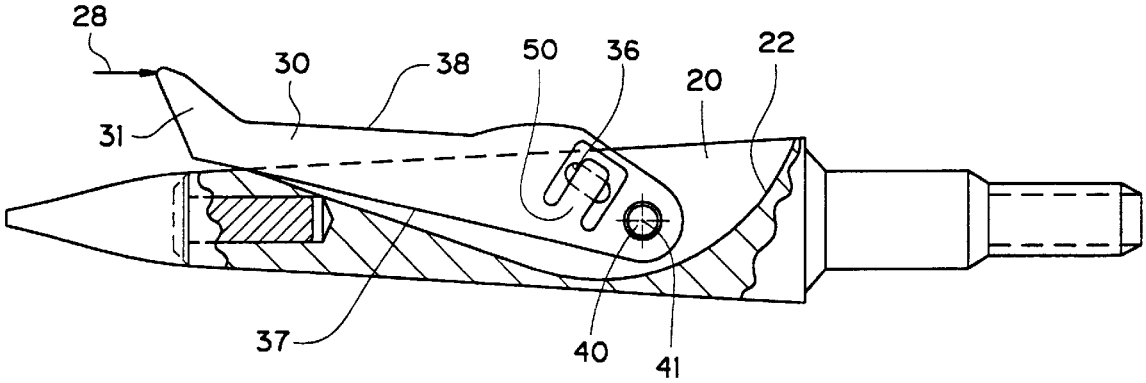
FIG. 9 is a partial cross-sectional front view of a blade-opening arrowhead, wherein bias means are mounted to the pivotal blade, according to another preferred embodiment of this invention.

It is apparent that the roles between flexible member 50 or detent 55 and recess or bore 36 can be reversed so that flexible member 50 or detent 55, for example, is integral with, connected to or otherwise attached to blade 30, and recess or bore 36 is formed within blade carrying body 20 or an equivalent element. FIG. 9 illustrates one preferred embodiment of this invention wherein such role reversal is accomplished by flexible member 50 formed as an integral part of blade 30 and recess 36 formed within blade carrying body 20.

Figure 10:
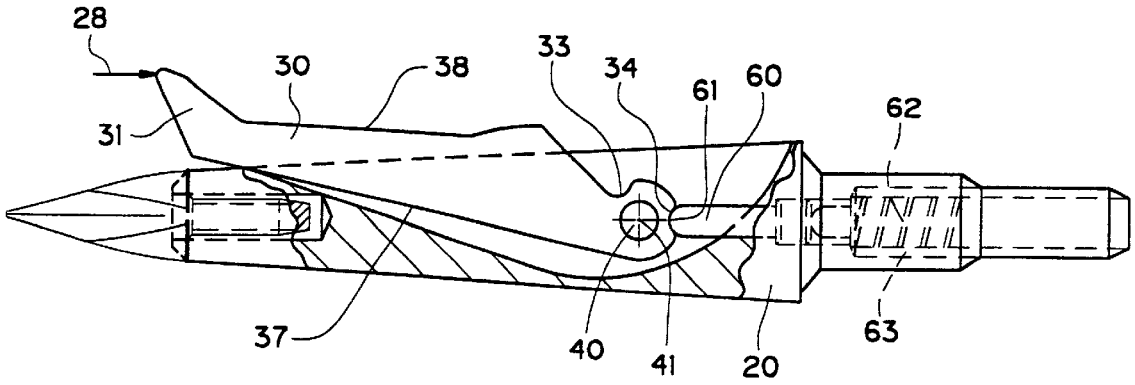
FIG. 10 is a partial cross-sectional front view of a blade-opening arrowhead, wherein bias means for maintaining the pivotal blade in a normally closed position comprise a spring-loaded plunger shaft, and the pivotal blade is in a fully closed position, according to another preferred embodiment of this invention.

FIG. 10 shows another preferred embodiment according to this invention, wherein the engagement means comprise plunger shaft 60 slidably mounted within a bore within blade carrying body 20. In such embodiment, the bias means preferably comprise spring 62 mounted with respect to blade carrying body 20 so that in the closed position of blade 30, spring 62 urges plunger shaft 60 into a mated position within notch 34 of blade 30, as shown in FIG. 10. Plunger shaft 60 preferably has arcuate tip 61 which mates within notch 34, so that as opening force 28 is applied to blade 30, movement of blade 30 overcomes the bias force and forces plunger shaft 60 out of notch 34, thus allowing blade 30 to rotate clockwise, as shown in FIG. 10, toward the fully open position.

Figure 11:
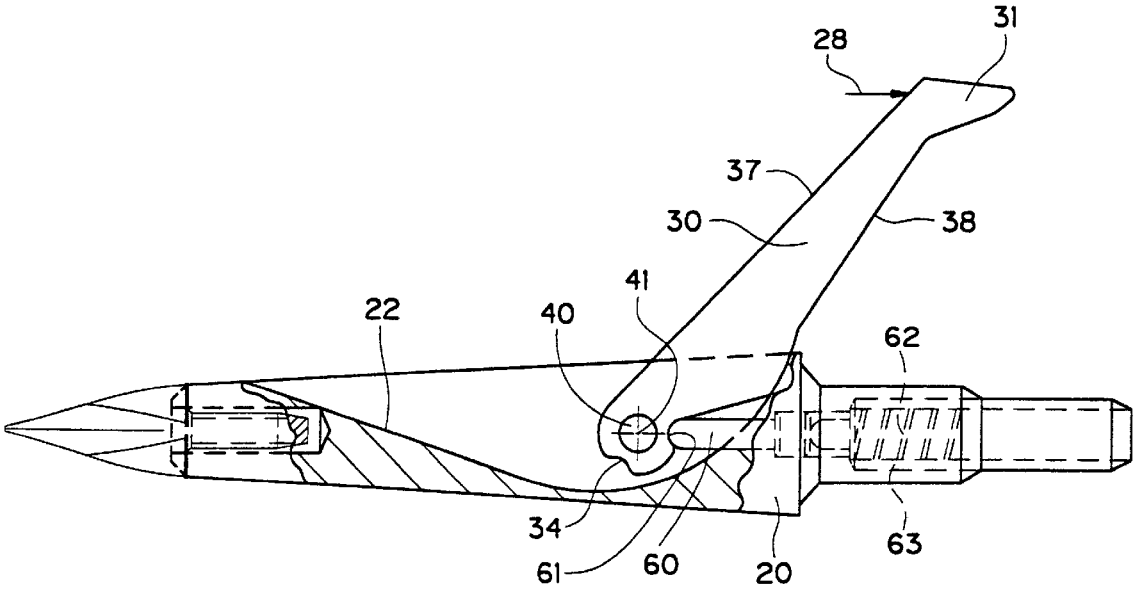
FIG. 11 shows the same blade-opening arrowhead as shown in FIG. 10, but with the pivotal blade in a fully open position.

As shown in FIG. 11, when blade 30 is in the fully open position, plunger shaft 60 is fully extended toward blade 30 and seats within a corresponding notch 33. As shown by hidden lines in FIGS. 10 and 11, spring 62 is preferably a coil spring which is preferably mounted within housing 63.

Figure 12:
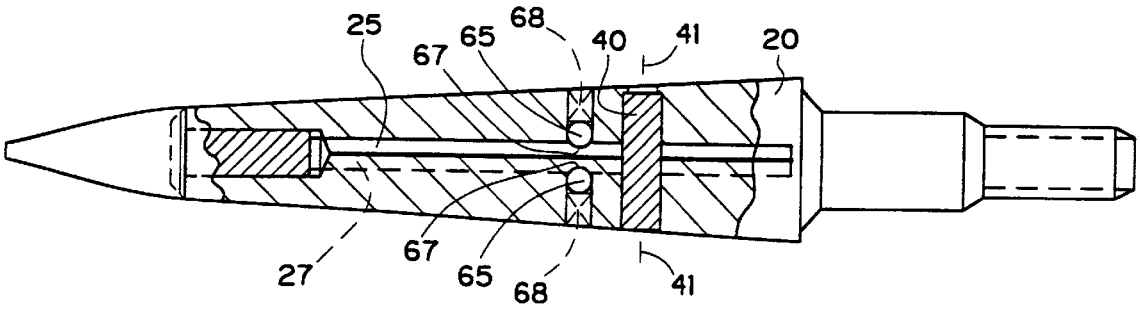
FIG. 12 shows a partial cross-sectional front view of a blade-opening arrowhead, wherein bias means for urging the pivotal blade into a normally closed position comprise a spring-loaded bearing element, according to another preferred embodiment of this invention.

In another preferred embodiment according to this invention, the engagement means comprise bearing member 65 slidably mounted within blade carrying body 20, as shown in FIG. 12. Bias means, such as spring 68, are used to urge bearing surface 67 within notch 34 of blade 30. Blade 30 is not shown in FIG. 12 but is preferably similar to blade 30 shown in FIG. 1, for example.

Stop means are used to present pivotal movement of blade 30 from proceeding further than the fully open position, for example as shown in FIGS. 2 and 6. In one preferred embodiment according to this invention, the stop means comprise blade 30 having blunt edge 38, which is generally opposite sharp edge 37, as shown in FIG. 2. FIG. 2 shows blunt edge 38 abutting blade carrying body 20 at sidewall 22. Blade 30 preferably makes surface contact with blade carrying body 20, so that impact forces are transferred between blade 30 directly through blade carrying body 20 and into an arrow shaft to which the blade-opening arrowhead of this invention is attached. It is desirable to minimize the forces transferred through pivot shaft 40 in order to prevent unnecessary wear between blade 30 and pivot shaft 40.

In one preferred embodiment according to this invention, sharp edge 37 abuts blade carrying body 20, as shown in FIGS. 1 and 5, when blade 30 is in the closed position. However, it is apparent that flexible member 50 and notch 34 can be designed so that sharp edge 37 does not contact blade carrying body 20 when blade 30 is in the normally closed position.

According to one preferred embodiment of this invention, blade carrying body 20 has two closed slots 25 and 27, as shown in FIG. 4A. Closed slot 25 and closed slot 27 are preferably offset with respect to each other, so that an island or web 23 of material, for example the same material which forms blade carrying body 20, is positioned between closed slot 25 and closed slot 27. Such arrangement of blade carrying body 20 results in a structural member that provides significantly increased strength over blade carrying body 20 having open slot 29 passing completely through the member.

Figure 16:
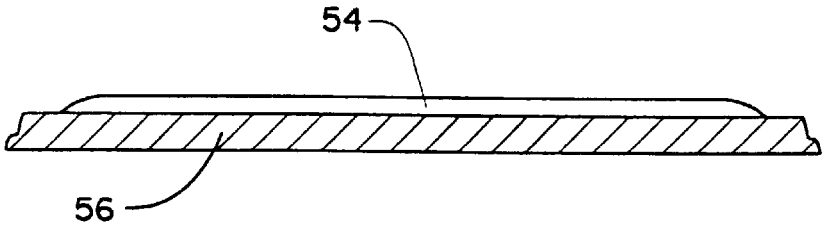
FIG. 16 is a sectional view taken along line 16—16, of the spring element as shown in FIG. 15.
Figure 17:
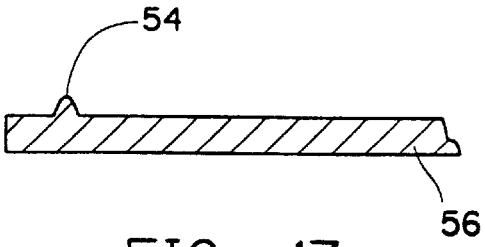
FIG. 17 is a sectional view taken along line 17—17, of the spring element as shown in FIG. 15.

As shown in FIGS. 15–17, rib 54 is an integral part of but can also be connected to or otherwise attached to baseplate 56 of flexible member 50. Rib 54 provides a bearing surface over which blade 30 slides when moving between the open and closed positions. Rib 54 can be used to eliminate blade wobble by tightening any cap established between baseplate 56 and blade 30.

FIGS. 18–20 show another preferred embodiment according to this invention wherein two blades 30 are each pivotally mounted with respect to blade carrying body 20, so that blade 30 is positioned entirely external with respect to blade carrying body 20. In such preferred embodiment, pivot shaft 40 comprises a screw which is threadedly engaged within an internally threaded bore within blade carrying body 20. However, it is apparent that other mechanical elements can be used to accomplish the same result of providing a shaft about which an externally mounted blade 30 can pivot, including but not limited to pivot shaft 40 as shown in FIG. 27. As shown in FIG. 19, blade 30 comprises recess 36 and flexible member 50 is either integral with or mounted to blade carrying body 20. It is apparent that the roles between recess 36 and flexible member 50 can be reversed so that blade 30 comprises flexible member 50 and so that blade carrying body 20 has recess 36. Blade 30 is preferably positioned adjacent mounting area 24 which is preferably formed by machining or otherwise forming a flattened surface upon blade carrying body 20. Mounting area 24 is preferably generally parallel to a longitudinal axis of the arrowhead, so that blades 30 remain generally parallel to such longitudinal axis and thus prevent undesirable steering of the arrowhead.

The bias means according to this invention are intended to comprise leaf springs, coil springs and/or any other suitable member that has a return force or a bias force. For example, the bias means may even comprise a material that returns to its initial shape after being bent, compressed or other vise deformed. As another example of bias means, two blades 30 can be pivotally mounted so that both blades 30 come relatively close to each other at some point throughout pivotal movement. One of such blades 30 can have raised portion 52 and the other blade 30 can have notch 34, resulting in engagement means to hold both blades 30 in a closed position with respect to blade carrying body 20. In such preferred embodiment, the bias means can comprise a cantilever portion of one blade 30 acting as a spring element when forced against the other blade 30.

As clearly shown in FIGS. 1, 2, 21 and 22, for example, in the closed position of blade 30 with respect to blade carrying body 20, tip portion 31 extends radially outward beyond outer or skin surface 35 of blade carrying body 20. Tip portion 31 of blade 30 is preferably rounded. As used throughout the specification and in the claims, the word rounded is intended to relate to tip portion 31 having no sharp points. The purpose of the rounded tip portion is to provide a bearing surface which can contact and slide with respect to a target surface, rather than puncture or cut the target surface. Such rounded tip portion 31 can result in better blade-opening performance upon blade-to-target impact.

As shown by the phantom lines in FIG. 24, through hole 58 can actually be a cutout section rather than a circular hole. The cutout section can provide the same result of pivot shaft 40 retaining leaf spring 53 in a mounted position with respect to blade carrying body 20, such as by providing interference.

Figure 26:
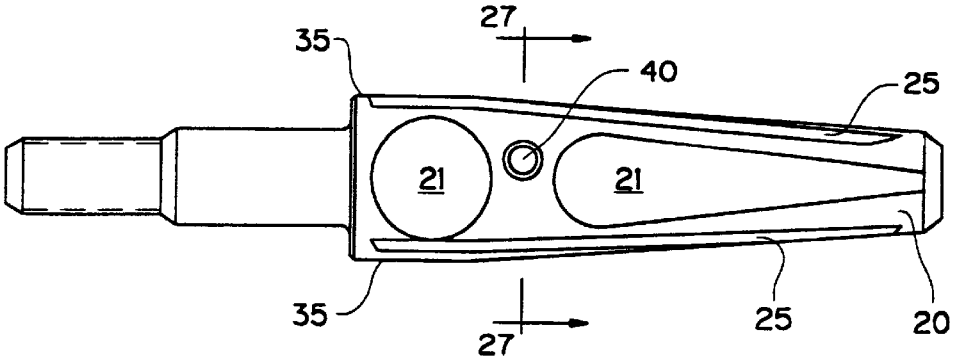
FIG. 26 is a front view of a blade carrying body, according to one preferred embodiment of this invention.
Figure 28:
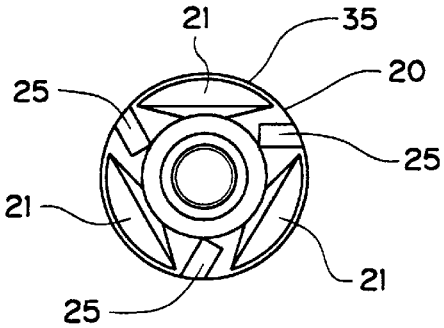
FIG. 28 is a side view looking toward a forward portion of the blade carrying body as shown in FIG. 26.
Figure 29:
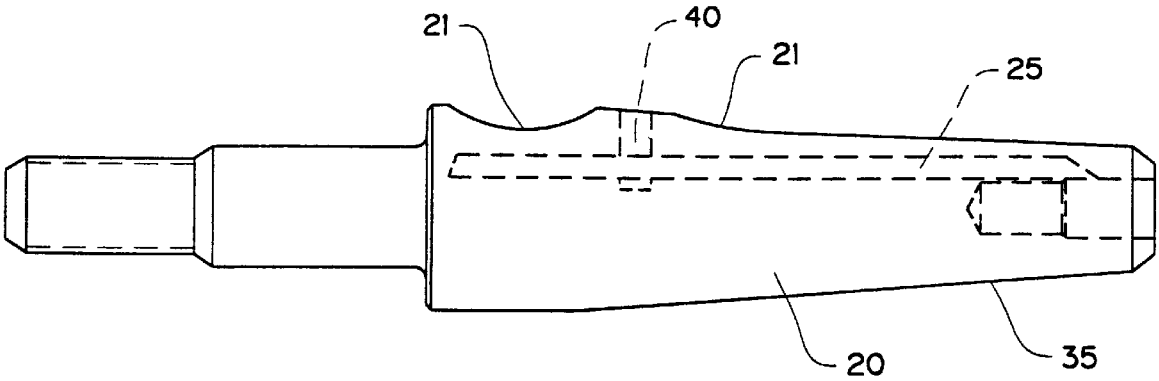
FIG. 29 is a partial cross-sectional front view of a blade carrying body, according to another preferred embodiment of this invention.

FIGS. 26–29 show blade carrying body 20 according to another preferred embodiment of this invention. Such blade carrying body 20 has three blades 30, not shown in the drawings. FIGS. 26, 28 and 29 show blade carrying body 20 having scallops 21 which comprise cross sections of blade carrying body 20 having a shorter cord length of outer surface 35 between adjacent closed slots 25 than an arc segment having a radius equal to a distance from a longitudinal centerline of blade carrying body 20 to a juncture between outer surface 35 and slot 25. Scallop 21 results in blade carrying body 20 having reduced surface area of outer surface 35, which results in reduced friction upon blade carrying body 20 as blade carrying body 20 penetrates into a target. As shown in FIGS. 26 and 29, blade carrying body 20 has one scallop 21 forward and another scallop 21 rearward of pivot shaft 40. However, it is apparent that scallop 21 may be only forward or only rearward with respect to pivot shaft 40.

The blade-opening arrowhead according to different embodiments of this invention has several operational and performance advantages over conventional blade-opening arrowheads. For example, the engagement means according to this invention result in a snap locking blade retention system wherein the user senses a positive snap action resulting from the bias means urging the engagement means against blade 30, such as when moving blade 30 into the fully closed position. The bias means and engagement means according to this invention can be properly designed so that blade 30 releases from the fully closed position, in an opening direction, immediately and responsively when a sufficient opening force 28 is applied to blade 30. Because the bias means and engagement means of this invention maintain blade 30 in the closed position, once the bias force is overcome and blade 30 moves in the opening direction, blade 30 need not overcome closing forces, such as those applied by conventional O-rings, wraps or other annular bands. Once blade 30 according to this invention moves from the closed position, blade 30 free-wheels into the fully open position, thereby exposing sharp edges 37. Because of the increased bearing surface contact between blade 30 and blade carrying body 20 according to this invention, forces are transferred through each blade 30, blade carrying body 20 and the arrow shaft, as if such three elements were an integral unit.

It is apparent that the components of the blade-opening arrowhead according to this invention can be constructed of relatively high-strength materials, such as lightweight metals, graphite, graphite composites and other suitable materials known to those skilled in the art. Although certain components shown in the drawings may be identified as metal, plastic or composite, it is apparent that various materials can be interchanged without departing from the desired results of a blade-opening arrowhead according to this invention. It is also apparent that the different bias means, engagement means and pivot means can be interchanged throughout the above-discussed and other preferred embodiments according to this invention, without departing from the desired results.

Figure 30:
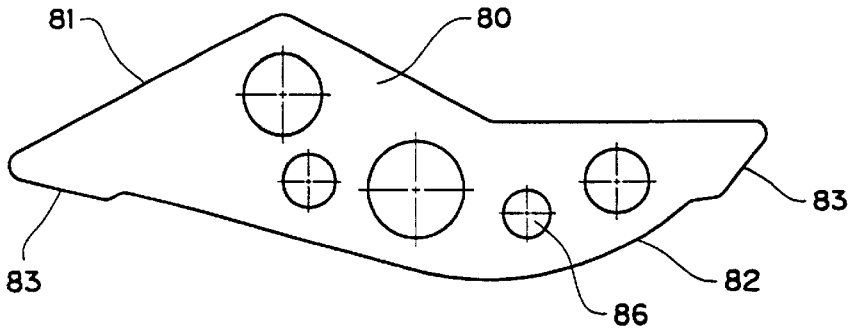
FIG. 30 is a front view of a fixed blade, according to another preferred embodiment of this invention.
Figure 31:
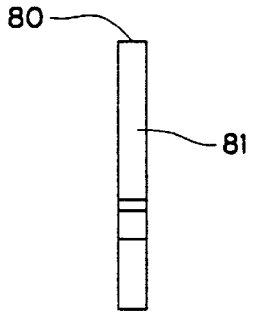
FIG. 31 is a side view of the fixed blade as shown in FIG. 30.

FIGS. 30 and 31 show another preferred embodiment of this invention comprising blade 80, which is preferably mounted in a fixed position with respect to blade carrying body 20. As used throughout this specification and in the claims, the word fixed is intended to relate to blade 80 remaining in a mounted position, not a pivotal position such as blade 30 as previously described, with respect to blade carrying body 20; it is apparent that when mounted in a fixed position with respect to blade carrying body 20, blade 80 may move slightly with respect to blade carrying body 20, due to manufacturing tolerances of blade carrying body 20, blade 80 and/or pin 88.

Figure 32:
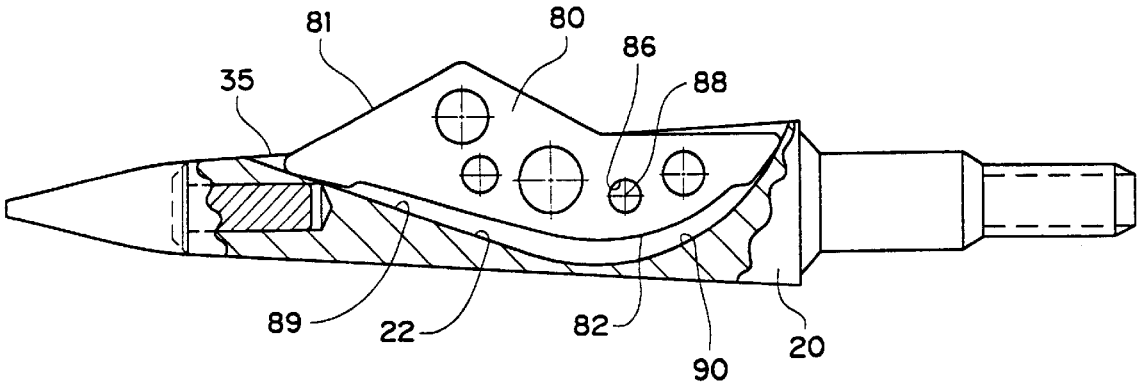
FIG. 32 is a partial cross-sectional front view of a fixed blade mounted within a slot of a blade carrying body, according to one preferred embodiment of this invention.

FIG. 32 shows blade 80 mounted within closed slot 27 of blade carrying body 20. It is apparent that blade 80 can be mounted within open slot 29 or any other shape of a slot within blade carrying body 20 that accommodates the overall shape of blade 80. As shown in FIGS. 30 and 32, blade 80 comprises leading edge 81. As shown in FIG. 31, leading edge 81 is blunt and such blade 80 can be used as a target or practice blade. It is possible to replace previously described pivotal blade 30 with fixed blade 80, so that the arrowhead of this invention can be used for target practice. The particular dimensions and weight of blade 80 can be designed to provide the arrowhead of this invention with flight characteristics, when using one or more and preferably 2–4 fixed blades 80, that are similar to flight characteristics of the arrowhead of this invention having pivotal blades 30 in the closed position such as shown in FIG. 1.

In another preferred embodiment of this invention, leading edge 81 of blade 80 has a sharp edge. For example, it is possible to alter the shape of blade 80 to accommodate a sharp leading edge 81 that operates to cut into a target or other object in a manner similar to that of many conventional sharpened blades of conventional arrowheads. The mounting features of blade 80 as described in this specification and in the claims can be used in other conventional arrowheads to fixedly mount one or more blades with respect to the conventional ferrule or blade carrying body.

As shown in FIG. 32, a portion of blade 80 is mounted within a slot, such as but not limited to closed slot 27. When in a mounted position as shown in FIG. 32, a portion of blade

80 extends beyond surface 35. The amount of blade 80 that extends beyond surface 35 can be varied depending upon the particular use of blade 80. For example, in the preferred embodiment wherein leading edge 81 is sharp, it may be desirable to extend a larger portion of blade 80 beyond surface 35.

In one preferred embodiment according to this invention, sidewall 22 of blade carrying body 20 at least partially defines the slot in which blade 80 is positioned. As shown in FIG. 32, sidewall 22 comprises relatively straight portion 89 and arcuate portion 90. As shown in FIG. 30, blade 80 comprises bearing surfaces 83 positioned at a distance from each other. In one preferred embodiment of this invention, as shown in FIG. 32 blade 80 is positioned so that bearing surfaces 83 either abut or are adjacent sidewall 22. As shown in FIG. 32, one bearing surface 83 abuts or is adjacent straight portion 89 and the opposite bearing surface 83 abuts or is adjacent arcuate section 90. Such arrangement leaves a gap between mounted blade 80 and sidewall 22, as shown in FIG. 32. In a preferred embodiment where blade 80 comprises bearing surfaces 83 as shown in FIG. 30, for example, blade 80 has less rocking motion with respect to blade carrying body 22 when in a mounted position. Also with such preferred embodiment, it is not necessary to precisely match the curve of arcuate segment 82 to the cure of arcuate portion 90. In one preferred embodiment wherein blade 80 comprises bearing surfaces 83, blade 80 may comprise a straight portion or another irregularly shaped portion in lieu of the general shape of arcuate segment 82 as shown in FIG. 32.

As shown in FIG. 32, pin 88 is mounted within through hole 86 of blade 80. Pin 86 retains blade 80 in a mounted position with respect to blade carrying body 22. As shown in FIG. 32, pin 88 interferes with blade 80 so that blade 80 cannot move out of the slot, except for movement due to manufacturing tolerances associated with the elements. In one preferred embodiment of this invention as shown in FIG. 32, pin 88 has a generally circular cross section. However, it is apparent that pin 88, like pivot shaft 40, can have any other suitable cross-sectional shape. Pin 88 can even be formed as an integral part of blade carrying body 22. Similar to through hole 58 of baseplate 56 as previously discussed, a cutout section of blade 80 can be used in lieu of through hole 86 of blade 80 to accomplish the same result of pin 88 interfering with blade 80 to retain blade 80 in a mounted position with respect to blade carrying body 22.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An apparatus for mounting a blade at least partially within a slot of a blade carrying body of an arrowhead, the apparatus comprising:

a portion of the blade pivotally mounted within the slot, the blade carrying body having a sidewall at least partially defining the slot, the portion of the blade positioned adjacent the sidewall;

the blade pivoting between a closed position and an opened position;

an engagement mechanism engaging a first surface of the blade when the blade is in the closed position;

the engagement mechanism engaging a second surface of the blade when the blade is in the opened position;

a biasing mechanism applying a force to the engagement mechanism; and the engagement mechanism having an arcuate surface contacting one of the first surface with the blade in the closed position and the second surface with the blade in the opened position.

2. The apparatus for mounting a blade according to claim 1 wherein the engagement mechanism is displaceable with respect to the blade carrying body.

3. The apparatus for mounting a blade according to claim 1 wherein the engagement mechanism is displaceable along a longitudinal axis of the arrowhead.

4. The apparatus for mounting a blade according to claim 1 wherein the first surface is shaped to receive the arcuate surface.

5. The apparatus for mounting a blade according to claim 1 wherein the first surface forms a notch.

6. The apparatus for mounting a blade according to claim 1 wherein the second surface is shaped to receive the arcuate surface.

7. The apparatus for mounting a blade according to claim 1 wherein the second surface forms a notch.

8. The apparatus for mounting a blade according to claim 1 wherein the biasing mechanism comprises a coil spring delivering the force.

9. The apparatus for mounting a blade according to claim 1 wherein the engagement mechanism contacts the first surface with the blade in the closed position and contacts the second surface with the blade in the opened position.

10. The apparatus for mounting a blade according to claim 9 wherein the engagement mechanism has an arcuate surface.

11. The apparatus for mounting a blade according to claim 10 wherein the first surface of the blade is shaped to receive the arcuate surface.

12. The apparatus for mounting a blade according to claim 11 wherein the first surface forms a notch.

13. The apparatus for mounting a blade according to claim 12 wherein the second surface of the blade is shaped to receive the mechanism arcuate surface.

14. The apparatus for mounting a blade according to claim 13 wherein the second surface forms a notch.

15. The apparatus for mounting a blade according to claim 14 wherein the biasing mechanism comprises a coil spring delivering the force.

16. An apparatus for mounting a blade at least partially within a slot of a blade carrying body of an arrowhead, the apparatus comprising:

a portion of the blade pivotally mounted within the slot, the blade carrying body having a sidewall at least partially defining the slot, the portion of the blade positioned adjacent the sidewall;

the blade pivoting between a closed position and an opened position;

an engagement mechanism engaging a first surface of the blade when the blade is in the closed position;

the engagement mechanism engaging a second surface of the blade when the blade is in the opened position;

a biasing mechanism applying a force to the engagement mechanism; and the engagement mechanism comprising a plunger having an arcuate tip.

17. An apparatus for mounting a blade to a blade carrying body of an arrowhead, the apparatus comprising:

the blade pivotally mounted with respect to the blade carrying body;

the blade pivotable between a closed position and an opened position;

a displaceable arcuate surface engaging a first notched surface of the blade when the blade is in the closed position, the displaceable arcuate surface engaging a second notched surface of the blade when the blade is in the opened position; and a biasing mechanism applying a force to contact the displaceable arcuate surface with the first notched surface when the blade is in the closed position and with the second notched surface when the blade is in the opened position.

* * * * *